US007001649B2

(12) United States Patent
Wagner et al.

(10) Patent No.: US 7,001,649 B2
(45) Date of Patent: Feb. 21, 2006

(54) INTERMEDIATE TRANSFER RECORDING MEDIUM

(76) Inventors: Barbara Wagner, 1477 Oaklanding Rd., Mt. Pleasant, SC (US) 29464; Ming Xu, 2808 Gaston Gate, Mt. Pleasant, SC (US) 29464; Kimberlee Thompson, 1054 Anna Knapp Blvd., Apartment 23D, Mt. Pleasant, SC (US) 29464

( * ) Notice: Subject to any disclaimer, the term of this patent is extended or adjusted under 35 U.S.C. 154(b) by 0 days.

(21) Appl. No.: 10/080,147

(22) Filed: Feb. 19, 2002

(65) Prior Publication Data

US 2003/0000410 A1 Jan. 2, 2003

(30) Foreign Application Priority Data

Jun. 19, 2001 (WO) ..... PCT/US01/19648

(51) Int. Cl.
*B41M 5/40* (2006.01)

(52) U.S. Cl. ..... 428/32.51; 156/235; 427/152; 428/32.77; 428/32.78; 428/32.79

(58) Field of Classification Search ..... 156/235; 427/152; 428/32.81, 32.51, 32.77, 32.78, 428/32.79

See application file for complete search history.

(56) References Cited

U.S. PATENT DOCUMENTS

| | | | |
|---|---|---|---|
| 4,058,644 | A | 11/1977 | DeVries et al. |
| 4,078,886 | A | 3/1978 | DeFago et al. |
| 4,357,441 | A | 11/1982 | Hamamura et al. |
| 4,589,920 | A | 5/1986 | Kanada et al. |
| 4,605,418 | A | 8/1986 | Christie et al. |
| 4,694,302 | A | 9/1987 | Hackleman et al. |
| 4,730,021 | A | 3/1988 | Zom et al. |
| 4,732,616 | A | 3/1988 | Kondo et al. |
| 4,750,935 | A | 6/1988 | Prochaska et al. |
| 4,847,318 | A | 7/1989 | Dennis |
| 4,849,262 | A | 7/1989 | Uhl et al. |
| 4,874,798 | A | 10/1989 | Koleske et al. |
| 5,149,367 | A | 9/1992 | Reuter et al. |

(Continued)

FOREIGN PATENT DOCUMENTS

| | | |
|---|---|---|
| EP | 244 181 | 4/1987 |

(Continued)

*Primary Examiner*—Bruce H. Hess
(74) *Attorney, Agent, or Firm*—B. Craig Killough

(57) ABSTRACT

A color image is digitally printed onto an intermediate transfer medium. The image is subsequently transferred from the intermediate transfer medium to a final substrate, which may be a cellulosic textile, such as cotton. Bonding of the color images is provided by the reaction between compounds selected from each of two chemical groups contained in the intermediate transfer medium. The first groups comprises compounds with functional groups capable of reacting with active hydrogen, such as isocyanate or epoxy groups. The second group comprises compounds with functional groups containing active hydrogen, or compounds with functional groups containing active hydrogen after a conversion process. The functional groups of one or both reactive chemical groups may be protected either by blocking with internal or external blocking agents or by a physical barrier such as encapsulating agents. The blocking agents are removed by the application of energy, such as heat, during the transfer of the image from the intermediate transfer medium to the final substrate. The intermediate transfer medium may be comprised of additional components which may be combined with either or both of the above two chemical groups, or applied as separate layers. Examples of such components are a thermally expandable material, an exothermic chemical, a release agent, and/or absorbent material. Transferred images so produced have a soft hand, particularly when applied to a textile, and excellent fade and abrasion resistance.

18 Claims, 4 Drawing Sheets

2 = base sheet
3 = isocyanate layer
4 = polyol layer
5 = printed image

U.S. PATENT DOCUMENTS

| | | | |
|---|---|---|---|
| 5,270,363 | A | 12/1993 | Kluger et al. |
| 5,315,885 | A | 5/1994 | Szinyei |
| 5,380,769 | A | 1/1995 | Titterington et al. |
| 5,411,931 | A | 5/1995 | Kung |
| 5,418,018 | A | 5/1995 | Rudder et al. |
| 5,429,841 | A | 7/1995 | Batlaw et al. |
| 5,431,501 | A | 7/1995 | Hale et al. |
| 5,470,818 | A | 11/1995 | Nakamura et al. |
| 5,534,052 | A | 7/1996 | Mennicke et al. |
| 5,556,935 | A | 9/1996 | Traubel et al. |
| 5,563,195 | A | 10/1996 | Namba et al. |
| 5,607,482 | A | 3/1997 | Reiff et al. |
| 5,640,180 | A | 6/1997 | Hale et al. |
| 5,645,888 | A | 7/1997 | Titterington et al. |
| 5,646,090 | A | 7/1997 | Tamura et al. |
| 5,665,676 | A | 9/1997 | Nakamura et al. |
| 5,725,646 | A | 3/1998 | Krishnan et al. |
| 5,778,789 | A | 7/1998 | Krishnan et al. |
| 5,853,861 | A | 12/1998 | Held |
| 5,886,091 | A | 3/1999 | Harris et al. |
| 5,984,467 | A | 11/1999 | Bodager et al. |
| 6,036,808 | A | 3/2000 | Shaw-Klein et al. |
| 6,103,041 | A | 8/2000 | Wagner et al. |
| 6,105,502 | A | 8/2000 | Wagner et al. |
| 6,150,008 | A | 11/2000 | Nakayama et al. |

FOREIGN PATENT DOCUMENTS

| | | |
|---|---|---|
| EP | 933 226 A2 | 4/1999 |
| JP | 581520 | 9/1982 |
| WO | WO/99/56948 | 11/1999 |

2 = base sheet
3 = isocyanate layer
4 = polyol layer
5 = printed image

7 = base sheet
8 = isocyanate/polyol layer
9 = printed image

11 = base sheet
12 = polyol layer
13 = isocyanate layer
14 = printed image

16 = base sheet/absorbent
17 = expandable layer
18 = polyol/exothermic layer
19 = isocyanate layer
20 = printed image

INTERMEDIATE TRANSFER RECORDING MEDIUM

This application claims priority of PCT/US01/19648, filed 19 Jun. 2001.

BACKGROUND OF THE INVENTION

Transfer processes involve physically transferring an image from one substrate to another and can be achieved in several ways. One method is melt transfer printing where a design is first printed on paper using a waxy ink. Melt transfer printing has been used since the nineteenth century to transfer embroidery designs to fabric. A design is printed on paper using a waxy ink, then transferred with heat and pressure to a final substrate. The Star process, developed by Star Stampa Artistici di Milano, uses a paper that is coated with waxes and dispersing agents. The design is printed onto the coated paper by a gravure printing process using an oil and wax based ink. The print is then transferred to fabric by pressing the composite between heated calendar rollers at high pressure. The ink melts onto the final substrate carrying the coloring materials with it. Fabrics printed in such a method using direct dyes are then nip-padded with a salt solution and steamed. Vat dyes can also be used in the ink, but the fabric must be impregnated with sodium hydroxide and hydros solution and steamed. The residual waxes from the transfer ink are removed during washing of the fabric.

Conventional heat-melt thermal printing uses primarily non-active wax materials such as hydrocarbon wax, carnauba wax, ester wax, paraffin wax, etc. as heat-melt material. Though these wax or wax-like materials serve the purpose of heat-melt very well, they present problems when the product is used in a further transfer process, especially when the image is transferred to a fibrous material, such as a textile. The conventional wax materials are not chemically bonded or otherwise permanently bonded to the substrate, but are temporarily and loosely bound to the final substrate by the melting of wax during the transfer process. The resulting image is not durable, with the wax materials being washed away during laundering of textile substrates on which the image is transferred, particularly if hot water is used, along with the dyes or colorants which form the image in the thermal ink layer. Since, in most cases, the ink layer composition has a major percentage of wax or wax-like material, and the colorants used in such composition are either wax soluble and/or completely dispersed in wax material, the associated problems of poor wash fastness, color fastness, and poor thermal stability, of the final product result in rapid and severe image quality deterioration during the usage of the product.

Another method of transfer printing is film release transfer. Here the image is printed onto a paper substrate coated with a film of heat tackifiable resin. Upon application of heat and pressure to the back side of the image, the entire film containing the image is transferred to the final substrate. A process of thermal transfer wherein the ink physically bonds to the substrate is described in Hare, U.S. Pat. No. 4,773,953. The resulting image, as transferred, is a surface bonded image with a raised, plastic-like feel to the touch. Thermal transfer paper can transfer an image to a final substrate such as cotton, however, this method has several limitations. First, the entire sheet is transferred, not just the image. Second, such papers are heavily coated with polymeric material to bind the image onto the textile. This material makes the transfer area very stiff and has poor dimensional stability when stretched. Finally, the laundering durability is not improved to acceptable levels. The thermal transfer paper technology (cited Hare patent) only creates a temporary bond between the transfer materials and the final substrate. This bond is not durable to washing.

Another method of transfer employs the use of heat activated, or sublimation, dyes. One form of an appropriate transfer process using sublimation inks is described in Hale, et. al., U.S. Pat. No. 5,601,023, the teachings of which are incorporated herein by reference. In this situation, an image is printed onto an intermediate medium, such as paper, followed by application of heat and pressure to the back side of the intermediate medium while in contact with a final substrate. The dyes then vaporize and are preferentially absorbed by the final substrate. Sublimation dyes yield excellent results when a polyester substrate is used and are highly resistant to fading and abrasion caused by laundering. These dyes, however, have a limited affinity for substrates other than polyester, and give poor results on natural fibers such as cotton and wool.

A method of preparing an image receiving sheet for sublimation transfer utilizing isocyanate groups is described in DeVries, U.S. Pat. No. 4,058,644. Here, a polyisocyanate is reacted with a polyol to form a polyurethane containing free or blocked isocyanate groups. A print paste containing this polymer along with a sublimation dye is coated onto a paper substrate via roller coating, brush coating, silk screening, or similar method. The image may then be heat transferred to a cotton substrate. The application of heat to the back side of the printed image activates the sublimation dye as well as the blocked isocyanate groups. The isocyanate groups become unblocked at the transfer temperature and available to react with hydroxyl groups on the cellulose fibers, therefore forming a chemical bond with the cellulose fiber.

DeFago, et. al. in U.S. Pat. Nos. 3,940,246 and 4,029,467 also take advantage of the reactivity of isocyanate groups. Here, sublimation dyes containing active hydrogen may be combined in a print paste with a free or blocked isocyanate. The print paste is coated on a carrier sheet by a process such as silk screen, planographic, or relief-printing, then heat transferred to a textile substrate. The isocyanate groups may react with the active hydrogen on the sublimation dye and/or with an active hydrogen on a final substrate.

Yoshimura in U.S. Pat. No. 5,432,258 describes the use of a thermosetting adhesive layer coated onto a printed image, then heat transferred onto a ceramic substrate. The thermosetting adhesive layer contains an alkyl (meth)acrylate polymer and/or $\alpha,\beta$-unsaturated carboxylic acid and a cross-linking agent, such as an isocyanate. Upon heat transfer, the isocyanate reacts with the hydroxyl and carboxyl groups of the alkyl (meth)acrylate and $\alpha$-$\beta$-unsaturated carboxylic acid to form a resin that enhances adhesion of the image to the ceramic substrate.

SUMMARY OF THE INVENTION

The present invention relates to an intermediate medium for energy transfer of a digitally printed image to a final substrate. The ink used in printing the image may be any type known in the art, such as aqueous or solvent ink jet, wax thermal, phase change or laser and may be comprised of any type of colorant, including pigments or dyes. The intermediate medium is comprised of a base sheet and an image receiving layer or layers containing compounds selected from each of two chemical groups. The first group comprises compounds with functional groups capable of reacting with active hydrogen, such as isocyanate or epoxy groups. The second group comprises compounds with functional groups containing active hydrogen, such as hydroxyl or amino groups, or compounds with functional groups containing active hydrogen after a conversion process, such as anhydride groups.

To prevent premature reaction, these functional groups are protected by either a blocking group, or by the presence of a physical barrier, such as encapsulating agents. The protecting agents may be removed by the application of energy, such as heat, or other physical means.

After an image is printed onto the intermediate medium, the image may be transferred to a final substrate by the application of energy, such as heat, and pressure to the back side of the intermediate medium. The temperature presented during the heat transfer, or activation, step of the process is at or above the temperature necessary to unmask the protecting groups in the image receiving layer and/or layers of the intermediate transfer medium, and above the temperature at which printing onto the medium occurs. Bonding of the color images of the present invention is provided by the reaction between compounds selected from each of the two chemical groups. In addition, an active hydrogen containing final substrate, such as the hydroxyl groups of cotton or the amino or thiol groups of wool, may contribute to this binding process and provide additional binding sites for the final image. The transferred images so produced have a soft hand and excellent fade and abrasion resistance.

Additional optional materials may be included in the intermediate transfer medium which may be combined with either or both of the above two chemical groups, or applied as separate layers. Examples of such components are a thermally expandable material, an exothermic chemical, a release agent, and/or absorbent material.

DESCRIPTION OF THE PREFERRED EMBODIMENTS

Figure 1:
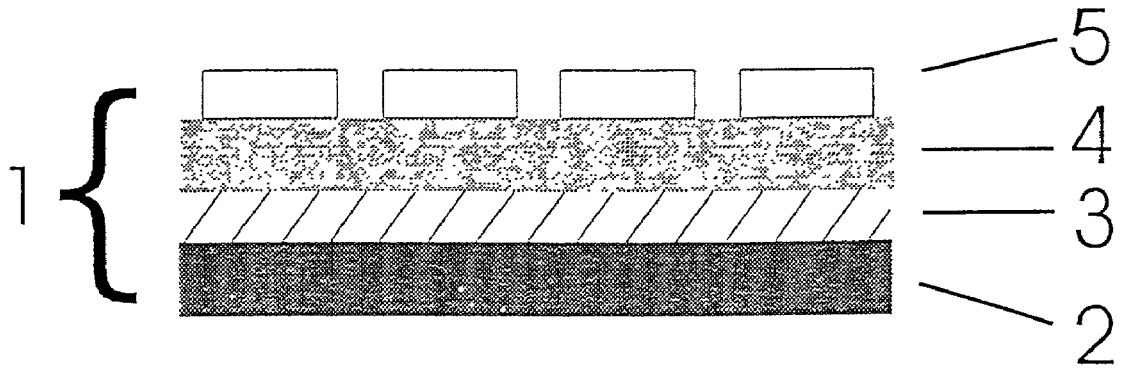
FIG. 1 shows a cross-section of an intermediate transfer medium (1) comprised of a base sheet (2) coated on one side with a layer of compound or compounds capable of reacting with active hydrogen (3), followed by a layer of compound or compounds containing active hydrogen (4). An image (5) is then printed onto the intermediate transfer medium.

In one embodiment of the present invention, an intermediate transfer medium (1) is prepared consisting of a first base layer (2), a second layer containing a compound or compounds capable of reacting with active hydrogen (3), which hereinafter may be referred to as an isocyanate or polyisocyanate, and a third layer containing a compound or compounds containing active hydrogen (4), which hereinafter may be referred to as a polyol (FIG. 1). Upon energy transfer of an image printed thereon (5), the compounds in layers 3 and 4 are transferred to the final substrate and simultaneously react to permanently bond the image to the final substrate. The transferred images so produced have a soft hand and excellent fade and abrasion resistance.

Figure 2:
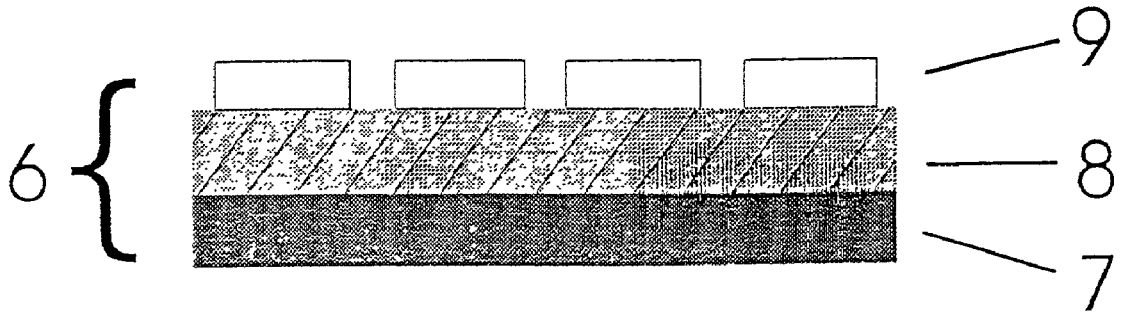
FIG. 2 shows a cross-section of an intermediate transfer medium (6) comprised of a base sheet (7) coated on one side with a layer containing both compounds capable of reacting with active hydrogen and compounds containing active hydrogens (8). An image (9) is then printed onto the intermediate transfer medium.

In another embodiment of the present invention, an intermediate transfer medium (6) is prepared consisting of a base layer (7), followed by a single layer (8) comprised of compounds capable of reacting with active hydrogen and compounds containing active hydrogen (FIG. 2). An image (9) is then printed onto the intermediate transfer medium and subsequently transferred onto a final substrate.

Figure 3:
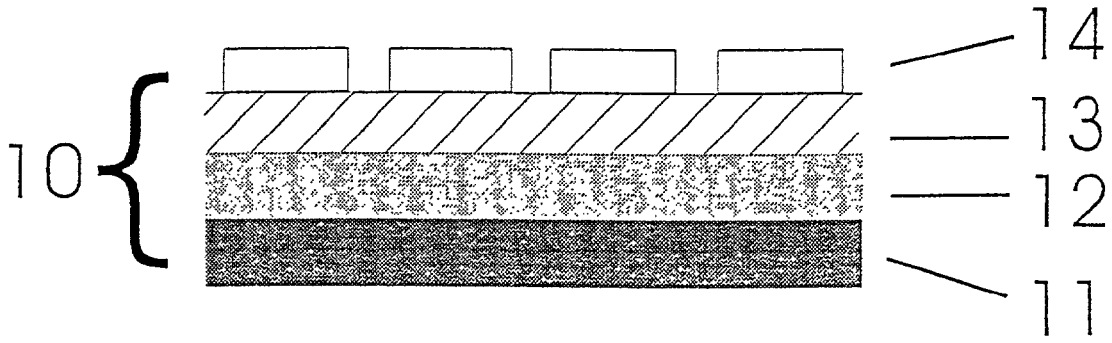
FIG. 3 shows a cross-section of an intermediate transfer medium (10) comprised of a base sheet (11) coated on one side with a layer of a compound or compounds containing active hydrogen (12), followed by a layer containing a compound or compounds capable of reacting with active hydrogen (13). An image (14) is then printed onto the intermediate transfer medium.

In a preferred embodiment of the present invention, an intermediate transfer medium (10) is prepared consisting of a first base sheet (11), a second layer containing a compound or compounds containing active hydrogen (12), followed by a third layer containing a compound or compounds capable of reacting with active hydrogen (13) (FIG. 3). An image (14) is then printed onto the intermediate transfer medium and subsequently transferred to a final substrate.

In a further embodiment of the present invention, other layers may be added to the intermediate transfer medium. Such layers include, but are not limited to, an expanding layer, exothermic chemical layer, release layer, and/or absorbent layer.

Figure 4:
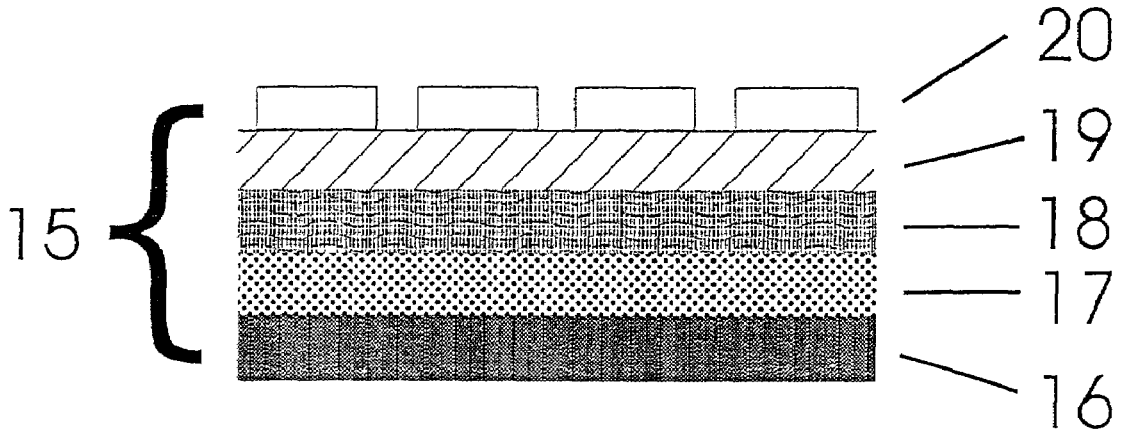
FIG. 4 shows a cross-section of an intermediate transfer medium (15) comprised of a base sheet with an absorbent material incorporated therein (16) coated on one side with a layer containing a thermally expandable material (17), followed by a layer containing a compound containing an active hydrogen and an exothermic material (18), and a layer containing a compound capable of reacting with active hydrogen (19). And image (20) is then printed onto the intermediate transfer medium.

In another embodiment of the present invention, some or all of the materials used in the above mentioned additional layers may be incorporated into the isocyanate and/or polyol layers. An example depicting the above two embodiments is illustrated in FIG. 4. In this example, the intermediate transfer medium (15) consists of a base sheet that has an incorporated absorbent material (16). Layers consisting of a thermally expandable layer (17), a layer incorporating a compound or compounds having an active hydrogen and an exothermic chemical (18), and a layer containing a compound or compounds capable of reacting with an active hydrogen (19) are added sequentially. An image (20) is then printed onto the intermediate transfer medium and subsequently heat transferred to a final substrate.

Bonding and/or crosslinking of the color images of the present invention are provided by the reaction between compounds selected from each of two chemical groups. The first group comprises compounds with functional groups capable of reacting with active hydrogen, such as isocyanate or epoxy groups. A preferred set of compounds comprising isocyanate groups is referred to as polyisocyanates. The second group comprises compounds with functional groups containing active hydrogen, such as hydroxyl, amino, thiol, carboxylic acid groups, or compounds with functional groups containing active hydrogen after a conversion process, such as carboxylic anhydride groups. A preferred set of compounds comprising hydroxyl groups is referred to herein as polyol.

In most transfer applications, reaction and bonding of the ink or image to the receiving substrate at the time of printing is not required. The ink will sufficiently attach to the receiver substrate or intermediate medium at the time of printing. In wax thermal printing, for example, the residual wax will sufficiently attach the colorants to the intermediate medium and preserve the image for subsequent transfer of the image. Permanent bonding at the time of printing onto the receiving substrate or intermediate medium would prevent subsequent transfer of the image from the receiving substrate or intermediate medium to the final substrate, and is undesired.

To achieve reaction at the desired time, at least one of the reactive groups is protected either by blocking agents, or by a physical barrier, such as encapsulating agents. The protecting or blocking agents are preferably removed by the application of energy, such as heat. Blocking as referred to herein means chemical blocking by means of a blocking agent. A polyisocyanate, for example, may be internally blocked or externally blocked. Internally blocked, also known as blocking agent-free, polyisocyanates are generally composed of two or more isocyanates forming a ring structure. The ring is relatively unstable to heat and at an appropriate temperature will break down to form the original free isocyanates. An example of an internally blocked polyisocyanate is the isophorone diisocyanate product, Crelan VP LS 2147 from Bayer.

A compound which is chemically blocked or physically encapsulated is referred to herein as protected. Other initiation processes may include, but are not limited to, radiation, chemical, pressure, and/or combinations thereof.

The base material will typically consist of a sheet material which can be transparent, translucent, or opaque. Useful transparent or translucent materials include, for example, cellulose acetate, polyethylene terephthalate, polystyrene, polyvinylchloride, and the like. Useful opaque materials include, for example, paper made of natural cellulose fiber materials, polyethylene-clad paper, opaque filled paper, and the like.

According to the present invention the base sheet may be coated firstly or secondly with a layer of polyisocyanate, or with a combination of polyisocyanate and polyol. Polyisocyanates suitable for the present invention are aliphatic and/or cycloaliphatic and/or aromatic polyisocyanates. Particularly preferred are polyisocyanates in which all the isocyanate groups are attached to aliphatic carbon atoms. Aliphatic polyisocyanates suitable for the present invention include those having the structure:

$$OCN—(CH_2)_n—NCO$$

where n is an integer from 2 to 16, and preferably 4 or 6, i.e., tetramethylene diisocyanate and hexamethylene diisocyanate (HDI). Examples of other suitable aliphatic and cycloaliphatic isocyanates are: 1-isocyanato-3-isocyanatomethyl-3,5,5-trimethylcyclohexane (known commercially as isophorone diisocyanate (IPDI)), trimethylhexamethylene diisocyanate, the isomeric bis(isocyanatomethyl)benzenes and toluenes, 1,4-bis(isocyanatomethyl) cyclohexane, 4,4'-methylene bis(cyclohexylisocyanate), cyclohexane-1,4-diisoyanate, and the like. Such polyisocyanates may be used either alone, or in a mixture with one or more of the other polyisocyanates listed above.

Examples of aromatic isocyanates suitable for the present invention are 2,4-toluene diisocyanate, 2,6-toluene diisocyanate, mixtures of 2,4- and 2,6-toluene diisocyanate, 4,4'-diphenylmethane diisocyanate, dianisidiene diisocyanate, and the isomeric benzene, xylene and naphthalene diisocyanates. Such aromatic polyisocyanates may be used alone or in a mixture with other aromatic polyisocyanates, such as those listed above, or with the aliphatic and/or cycloaliphatic polyisocyanates listed above.

In place of polyisocyanates, polyisothiocyanates, or compounds containing both isocyanate and isothiocyanate groups may be used, for example, hexamethylene diisothiocyanate, tetramethylene diisothiocyanate, 2,4- and 2,6-toluene diisothiocyanate.

To prevent premature reaction of the isocyanates or polyisocyanates, blocked or masked isocyanates or polyisocyanates may be used. A blocked isocyanate, as used herein, is derived from the reaction of a blocking agent and an isocyanate, or may be internally blocked. Such blocked isocyanates reform the original isocyanate upon removal of the blocking agents such as by heating, or by heating with nucleophilic reagents, and may produce the same products as the reaction of the same nucleophilic reagents with the parent isocyanates. Blocking and isocyanate groups are specifically chosen so that the temperature for unblocking is in the range of 60–220° C. Unblocking temperatures lower than 60° C. do not provide suitable storage stability for the printed intermediate medium and/or images printed thereon. In addition, the temperature required to remove the protecting agents from these chemical groups must be greater than the temperature at which printing onto the intermediate medium occurs. Typical heat transfer temperatures are in the range of 175–220° C., and therefore the unblocking temperature must be at or below this temperature. In addition, unblocking temperatures higher than 220° C. are undesirable since temperatures higher than this may damage the final substrate during heat transfer. Preferably, the unblocking reaction occurs upon the application of heat between 120° C. and 200° C.

Common examples of blocking agents include phenols and substituted phenols, alcohols and substituted alcohols, thiols, lactams such as alpha-pyrrolidinone, epsilon-caprolactam, mercaptams, primary and secondary acid amides, imides, aromatic and aliphatic amines, active methylene compounds, oximes of aldehydes and ketones and salts of sulfurous acid.

Catalysts may be included to speed up the cross-linking reaction between the compounds containing functional groups capable of reacting with active hydrogen and the compounds containing functional groups containing active hydrogen. Examples of catalysts for the isocyanate/polyol reaction include tertiary amines, such as triethylamine, triethylenediamine, hexahydro-N,N'-dimethyl aniline, tribenzylamine, N-methyl-piperidine, N,N'-dimethylpiperazine; alkali or alkaline earth metal hydroxides; heavy metal ions, such as iron(III), manganese(III), vanadium(V), or metal salts such as lead oleate, lead-2-ethylhexanoate, zinc(II) octanoate, lead and cobalt naphthenate, zinc(II)-ethylhexanoate, dibutyltin dilaurate, dibutyltin diacetate, and also bismuth, antimony, and arsenic compounds, for example tributyl arsenic, triethylstilbene oxide or phenyldichlorostilbene. Particularly preferred are dibutyl tin catalysts. Any amount of catalyst may be used which will effect the intended purpose. For example, dibutyltin dilaurate or dibutyltin diacetate may be used in a range of 0.5 to 4% by weight, based on the weight of the isocyanate.

According to the present invention, the above polyisocyanate may be a first or second layer on top of the base sheet. When the polyisocyanate layer described above is the first layer on top of the base sheet, the second layer may be comprised of polyol. When the polyisocyanate layer is the second layer, the first layer on the base sheet is the polyol. In addition to having separate polyisocyanate/polyol layers on the base sheet of the intermediate transfer medium, the polyisocyanate and polyol components may be combined and coated as a single layer on the base sheet. In a preferred embodiment of the present invention, the polyol comprises the first layer on top of the base sheet. The advantage of this arrangement is that the polyol acts not only as a cross-linking component with the polyisocyanate, but also serves as a release agent from the base sheet. Many polyols are wax-like materials which act as lubricants and release agents during the transfer of the printed image from the intermediate transfer medium to the final substrate.

Polyols suitable for use in the present invention may have a backbone structure of the polyether, polyester, polythioether, mixed polyester polyether or mixed polyether polythioether classes. Polyols with a polyether backbone are preferred. In general, polyols or mixtures thereof may have an average molecular weight from 500 to 50,000 and preferably, an average molecular weight in the range of 1,500 to 2,700. The resulting composition, with the rest of the components in the ink layer, is suitable for the digital printing process. The average molecular weight of the whole of all polyol compounds is defined as the sum of the product of the molecular weight and the mole fraction of each polyol compound in the mixture. A preferred embodiment of a polyol layer comprises a mixture of high molecular weight polyol compounds having molecular weights of 3000 to 10,000, and low molecular weight polyol compounds having molecular weights of not greater than 1000. It will be appreciated by one skilled in the art that the above list of suitable diols, triols, tetrols, etc. is not exhaustive, and that other hydroxyl-containing materials may be used without departing from the spirit of the present invention.

The polyisocyanate and the polyol compounds are preferred to have an average functionality between two and four. The ratio of the equivalents of isocyanate groups to the equivalents of hydroxyl groups may range from 1:2 to 10:1, preferably 1:1 to 2:1.

Additional layers may be present as part of the intermediate transfer medium. Such layers include, but are not limited to, an expanding layer, exothermic chemical layer, release layer, and/or absorbent layer. Materials used in the construction of any or all of these additional layers may alternatively be incorporated into the polyisocyanate and/or polyol layers. For example, a thermally expandable layer may be used separately or combined with the first layer applied to the base sheet to aid in the release of the printed image from the intermediate transfer medium. Foaming agents that evolve gas as the result of thermal decomposition are preferably used in as thermally expandable material. Examples are organic expanding agents such as azo compounds, including azobisisobutyroniltrile, azodicarbonamide, and diazoaminobenzene; nitroso compounds such as N,N'-dinitrosopentamethylenetetramine, N,N'-dinitroso-N, N'-dimethylterephthalamide; sulfonyl hydrazides such as benzenesulfonyl hydrazide, p-toluenesulfonyl hydrazide, p-toluenesulfonyl azide, hydrazolcarbonamide, acetone-p-sulfonyl hydrazone; and inorganic expanding agents, such as sodium bicarbonate, ammonium carbonate,and ammonium bicarbonate.

A thermally expandable layer may be produced which comprises volatile hydrocarbons encapsulated in a microsphere which bursts upon the application of heat. The gaseous products produced upon bursting expand the layer. Thermally expandable microcapsules are composed of a hydrocarbon, which is volatile at low temperatures, positioned within a wall of thermoplastic resin. Examples of hydrocarbons suitable for practicing the present invention are methyl chloride, methyl bromide, trichloroethane, dichloroethane, n-butane, n-heptane, n-propane, n-hexane, n-pentane, isobutane, isophetane, neopentane, petroleum ether, and aliphatic hydrocarbons containing fluorine such as Freon, or a mixture thereof.

Examples of the materials which are suitable for forming the wall of the thermally expandable microcapsule include polymers of vinylidene chloride, acrylonitrile, styrene, polycarbonate, methyl methacrylate, ethyl acrylate and vinyl acetate, copolymers of these monomers, and mixtures of the polymers of the copolymers. A crosslinking agent may be used as appropriate. The diameter of the thermally expanded microcapsule is in the range of 0.1–300 microns, and preferably within a range of 0.3–50 microns, with a greater preference of a range of 0.5–20 microns.

Another example of an optional layer or material for use in the present invention is an exothermic layer or chemical. For example, the polyisocyanate and/or polyol layers may contain a heat sensitive material which undergoes an exothermic reaction upon application of sufficient energy. This energy, such as heat, would be externally applied to the back of the intermediate transfer medium during transfer of the printed image from the intermediate transfer medium to the final substrate. The additional heat generated by this exothermic reaction would effectively lower the amount of externally applied energy necessary to transfer the image from the intermediate transfer medium to the final substrate. Examples of such exothermic materials are aromatic azido compounds, such as 4,4'-bis(or di)azido-diphenylsulfone which will undergo thermal decomposition with the loss of molecular nitrogen. Other examples are aromatic azido compounds carrying a water-solubilizing group, such as a sulfonic acid or carboxylic acid group. These exothermic materials typically show an exotherm in the temperature range of 170–200° C. Typical heat transfer temperatures are in the range of 175–220° C. and thus sufficient to initiate this exotherm.

Aside from the polyol layer, an additional release layer may be desired. Examples of additional release agents include solid waxes, such as amide wax, polyethylene wax, and Teflon powder; phosphate- or fluorine-containing surfactants; and silicone-containing compounds.

If an absorbent material is used it may be part of the base sheet or a separately applied layer. The absorbent material helps to absorb the bulk of a liquid ink. Liquid inks that may be used may contain water, emulsifying enforcing agents, solvents, co-solvents, humectants, dispersants, and/or surfactants. Absorbent materials for ink printing papers are well known in the art and include, but are not limited to, porous materials such as silica gel, aluminum oxide, zeolites, porous glass; polymers based on methacrylate, acrylate, and the like; monomers with suitable cross-linking agents such as divinylbenzene; liquid swellable materials such as clays and starches, for example, montmorillonite type clays; fillers, such as calcium carbonate, kaolin, talc, titanium dioxide, and diatomaceous earth. The absorbent layer may contain an exothermic material as described above.

The above described polyisocyanate, polyol, and any other layers may be applied to the base sheet by any of the known methods, such as coating or spraying. Coating, for example, can be done either on a paper machine, off a paper machine, or a combination of both. The polyisocyanate and polyol components may be combined with a binder material to help anchor the components to the base sheet or other layers. Examples of such binding materials are known in the art and include water-soluble polymers, such as polyvinyl alcohol, modified polyvinyl alcohol, cellulose derivatives, casein, gelatin, sodium alginate, and chitosin; water-insoluble polymers such as styrene-butadiene copolymers, acrylic latex, and polyvinyl acetate; and chemicals which react irreversibly with water and/or solvents to render them non-volatile, such as polyvinyl alcohol.

An example of a coating which combines ingredients for a single layer coated on a base sheet, as illustrated in FIG. 2, would be:

EXAMPLE

| | Weight percent |
|---|---|
| Polyisocyanate | 25 |
| Polyol | 59 |
| Catalyst | 1 |
| Binder | 15 |

The final substrates of the present invention may be, for example, a textile material, ceramic, metal, wood, or glass. Examples of suitable textile materials are cellulosic fiber, such as cotton, linen, or viscose; protein fibers, such as wool and silk; polyamide fiber, such as nylon 6.6; mixtures of cellulose or polyamide with polyester; and other synthetic fibers, such as acrylic and polyester. Preferred final substrates are those containing active hydrogen capable of cross-linking with a polyisocyanate, such as cellulosic fiber.

What is claimed is:

1. An intermediate transfer media produced by a process comprising the steps of coating a substrate with at least one compound having at least one functional group capable of reacting with active hydrogen, coating said substrate with at least one compound having at least one functional group comprising active hydrogen, and subsequently printing an image upon said intermediate transfer media.

2. An intermediate transfer media produced by the process described in claim 1, further comprising the step of applying a blocking agent to said substrate, wherein said blocking agent prevents a reaction between said at least one compound having at least one functional group capable of reacting with active hydrogen and at least one compound having at least one functional group comprising active hydrogen, and wherein a property of said blocking agent of preventing a reaction between said at least one compound having at least one functional group capable of reacting with active hydrogen and at least one compound having at least one functional group comprising active hydrogen is removed by the application of energy to said blocking agent.

3. An intermediate transfer media produced by the process described in claim 2, wherein said image is transferable from said intermediate transfer media to a second substrate upon the application of energy to said blocking agent.

4. An intermediate transfer media produced by the process described in claim 3, wherein said at least one compound having at least one functional group which reacts with active hydrogen is an isocyanate.

5. An intermediate transfer media produced by the process described in claim 2, wherein said energy is heat energy.

6. An intermediate transfer media produced by the process described in claim 1, wherein said at least one compound having at least one functional group comprising active hydrogen is a polyol.

7. An intermediate transfer media produced by the process described in claim 1, wherein said at least one compound having at least one functional group which reacts with active hydrogen is an isocyanate.

8. An intermediate transfer media produced by the process described in claim 1, wherein said at least one compound having at least one functional group which reacts with active hydrogen is an epoxide.

9. An intermediate transfer media produced by the process described in claim 1, wherein said at least one compound having at least one functional group comprising active hydrogen is converted from an anhydride.

10. An intermediate transfer media produced by the process described in claim 1, further comprising the step of applying a material that undergoes an exothermic reaction upon application of energy to said substrate.

11. An intermediate transfer media produced by the process described in claim 1, wherein said substrate comprises a thermally expandable material.

12. An intermediate transfer media produced by a process comprising the steps of:

applying a first layer to a substrate, said first layer comprising at least one compound having at least one functional group capable of reacting with active hydrogen;

applying a second layer to said substrate, said second layer comprising at least one compound having at least one functional group comprising active hydrogen.

13. An intermediate transfer media produced by the process described in claim 12, further comprising the step of subsequently printing an image on the intermediate transfer media produced by the process described in claim 12.

14. An intermediate transfer media produced by the process described in claim 12, further comprising the step of applying a blocking agent to said substrate, wherein said blocking agent prevents a reaction between said at least one compound having at least one functional group capable of reacting with active hydrogen and at least one compound having at least one functional group comprising active hydrogen, and wherein the property of said blocking agent of preventing a reaction between said at least one compound having at least one functional group capable of reacting with active hydrogen and at least one compound having at least one functional group comprising active hydrogen is removed by the application of energy to said blocking agent.

15. An intermediate transfer media produced by the process described in claim 12, wherein said second layer comprises at least one compound having at least one functional group comprising at least one active hydrogen further comprises a material which undergoes an exothermic reaction upon application of heat.

16. An intermediate transfer media produced by the process described in claim 12, wherein said first layer comprises at least one compound comprising at least one functional group capable of reacting with active hydrogen further comprises a material which undergoes an exothermic reaction upon application of heat.

17. An intermediate transfer media produced by the process described in claim 12, wherein said second layer comprising at least one compound having at least one functional group comprising at least one active hydrogen further comprises a thermally expandable material.

18. An intermediate transfer media produced by the process described in claim 12, wherein said first layer comprising at least one compound comprising at least one functional group capable of reacting with active hydrogen further comprises a thermally expandable material.

* * * * *